US005677071A

United States Patent [19]

Kang

[11] Patent Number: 5,677,071

[45] Date of Patent: Oct. 14, 1997

[54] FLUORESCENT FILM STRUCTURE OF COLOR BRAUN TUBE

[75] Inventor: Seoug Wan Kang, Kyungsangbuk-do, Rep. of Korea

[73] Assignee: LG Electronics, Inc., Seoul, Rep. of Korea

[21] Appl. No.: 633,215

[22] Filed: Apr. 16, 1996

[30] Foreign Application Priority Data

Apr. 17, 1995 [KR] Rep. of Korea ..... 8972/1995

[51] Int. Cl.[6] ..... B05D 5/06

[52] U.S. Cl. ..... 428/690; 428/691; 427/64; 427/68; 252/301.36; 313/478; 313/474; 313/477; 348/781; 348/786

[58] Field of Search ..... 427/64, 68; 252/301.36; 428/690, 691; 313/478, 474, 477; 348/781, 786

[56] References Cited

U.S. PATENT DOCUMENTS 5,310,504 5/1994 Ihm et al. ..... 252/301.36
5,322,707 6/1994 Ihm et al. ..... 427/64

*Primary Examiner*—Charles Nold

[57] ABSTRACT

The present invention is to improve color purity and brightness of a color Braun tube by constructing a fluorescent film for a red fluorescent material as a laminated structure. The present invention relates to a structure of a fluorescent film for a color Braun tube wherein the fluorescent film of the red fluorescent material comprises fluorescent material layers having a laminate structure made of two different compositions of $Y_2O_2S$: Eu and $Y_2O_3$:Eu.

6 Claims, 2 Drawing Sheets

FLUORESCENT FILM STRUCTURE OF COLOR BRAUN TUBE

FIELD OF THE INVENTION

The present invention relates to a fluorescent film structure of a color Braun tube. More specifically, the present invention relates to a fluorescent film structure in which two or more multi-layer fluorescent materials are constructed on a fluorescent film of a red fluorescent material, to enhance the white radiation brightness.

BACKGROUND OF THE INVENTION

Three different colored fluorescent materials are used in a color Braun tube, a fluorescent lamp, a projection type cathode-ray tube, or the like. A color Braun tube generally comprises as its essential components a fluorescent screen subsequently coated with three-color (i.e. green, blue, red) fluorescent materials which radiate by an electronic ray on an inner surface of a panel with a whole surface of glass.

The process for manufacturing such a fluorescent screen is largely divided into a coating of light-absorbing black material (BM) [FIG. 1] and a coating of three-color fluorescencer phosphor (PH) [FIG. 2].

As illustrated in FIG. 1, the process of coating of light-absorbing BM comprises washing and drying panel (1) and then injecting and coating a photoresist thereto; light-exposing and developing by the use of a mask which defines the portion to which three primary color fluorescent materials should be formed, to form a photoresist mask; coating graphite; and etching, developing and drying the said photoresist mask to form a graphite band (2) having a thickness of about 5–10 μm.

Subsequently, as illustrated in FIG. 2, the panel to which a BM has been formed is washed, and then coated with a precoat and dried. A mixture of a green fluorescent material, photosensitizer, polyvinyl alcohol, light cross-linker and dispersing agent is coated thereto, dried, light-exposed and developed to form a green fluorescent film (3). Then a blue fluorescent film (4) and a red fluorescent film (5) are formed by the same procedure.

Then, an emulsion film is formed and Al-deposited.

In the three color fluorescent films, the green fluorescent material comprises ZnS:Cu, Al, ZnS:Au, Al, [(Zn, Cd)S:Cu, Al] etc.; the blue fluorescent material comprises ZnS:Ag, ZnS:Ag, Al, etc., and the red fluorescent material comprises $Y_2O_2S$:Eu, $Y_2O_3$:Eu, etc.

These three.-color fluorescent materials should have good radiation color purity as three primary colors of light, and high radiation efficiency to the electronic ray stimulating energy, i.e., high radiating brightness.

At present, a same colored pigment as the radiation color is adhered onto the surface of the fluorescent material core in order to improve the radiation color purity and contrast of the screen. Though such a pigment-adhered fluorescent material is advantageous for the color purity and contrast, it is disadvantageous for the radiation brightness.

It is because same colored pigment absorbs light (of whole wavelength range) by its essential characteristics, but the red pigment absorbs little of the light of red wavelength range while it largely absorbs the light of other wavelength range to cause the above phenomenon.

SUMMARY OF THE INVENTION

The object of the invention is to construct a red fluorescent film with a laminate structure having a first red fluorescent film layer and a second red fluorescent film layer, in order to enhance the red radiation and white brightness.

To achieve the above object, the present invention provides a fluorescent film for a color Braun tube comprising fluorescent films formed with three color fluorescent materials of green, blue and red, wherein the fluorescent film of the red fluorescent material has fluorescent material layers having a laminate structure made of two or more different composition.

DETAILED DESCRIPTION OF THE PREFERRED EMBODIMENT

Figure 1:
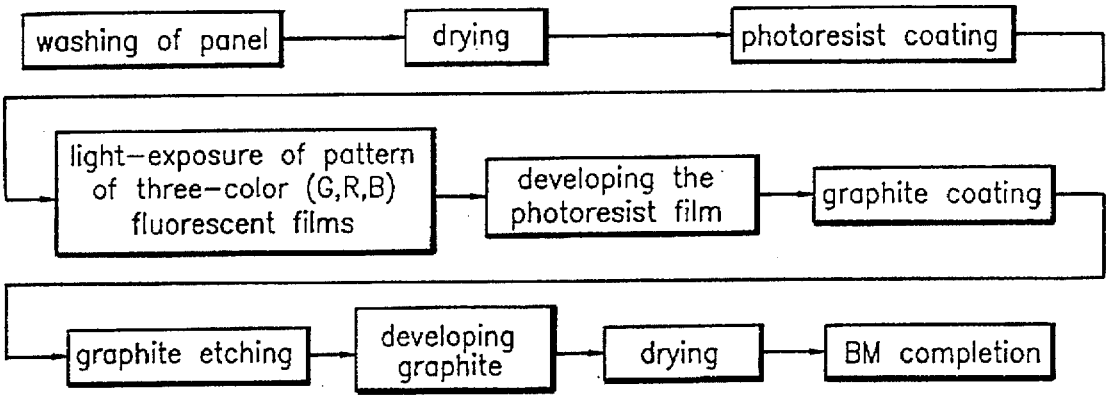
FIG.1 prior art
FIG. 1 is a flow chart of a conventional process for graphite coating.
Figure 2:
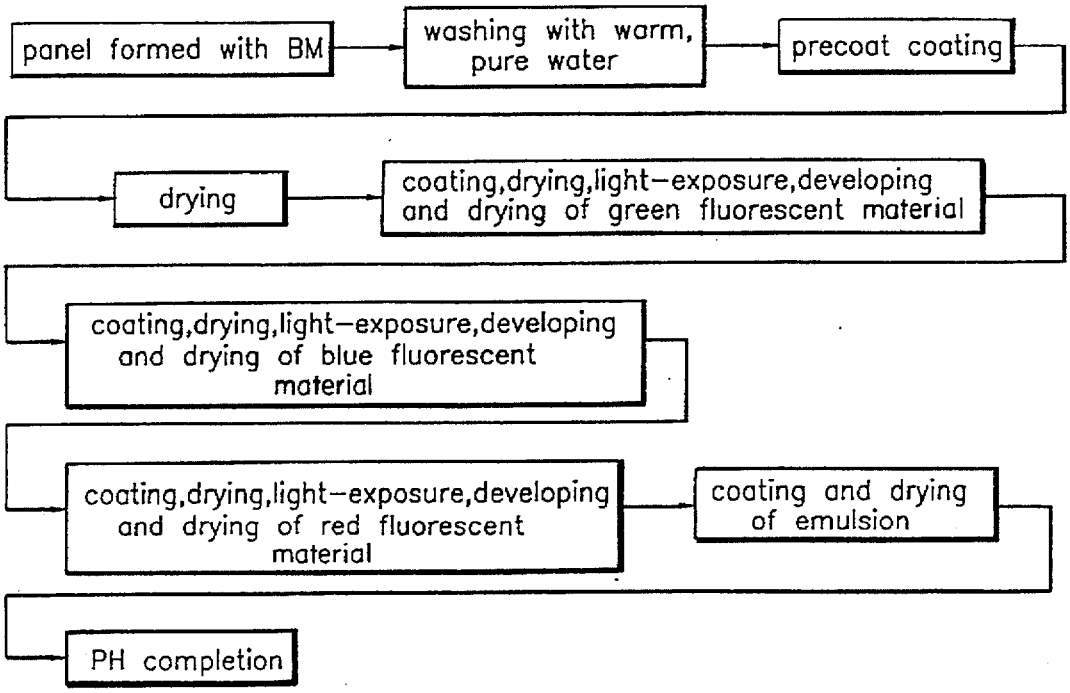
FIG.2 prior art
FIG. 2 is a flow chart of a conventional process for fluorescencer coating.
Figure 3:
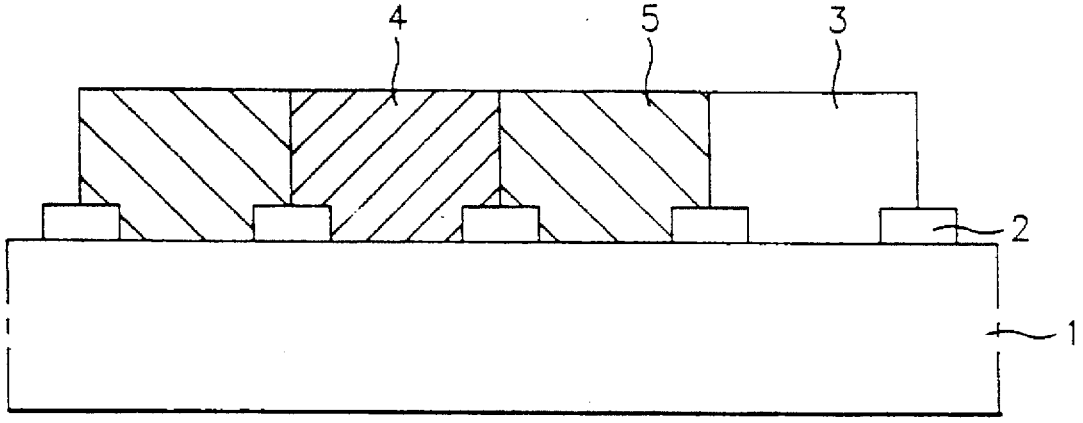
FIG.3 prior art
FIG. 3 is a structural view of a conventional fluorescent film.
Figure 4:
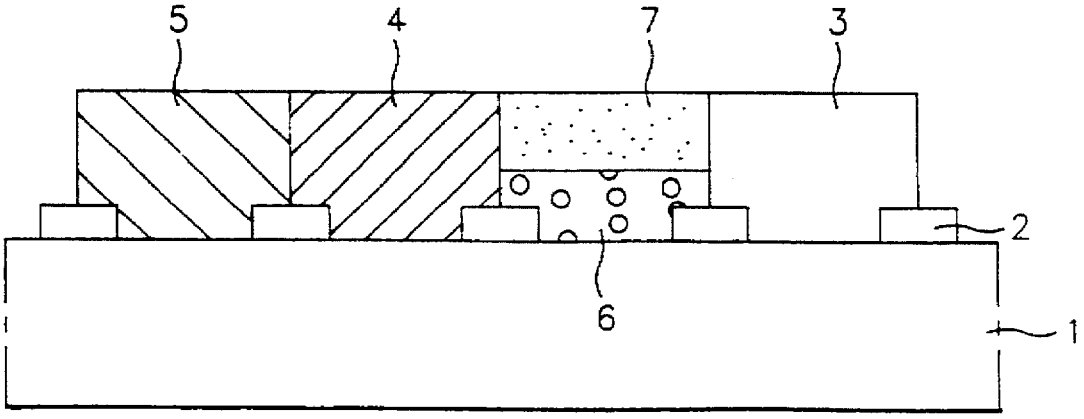
FIG. 4 is structural view of a fluorescent film according to the present invention.

As shown in FIG. 4, illustrating the structure of the fluorescent film according to the present invention, the fluorescent film of the present invention is different from the conventional fluorescent film [FIG. 3] in that the former comprises multi-layer structure of the red fluorescent film.

On the inner surface of a face plate of panel (1) to which BM has been formed, a green fluorescent film (3) and a blue fluorescent film is formed, and the red fluorescent film comprises the first red fluorescent material layer (6) and the second red fluorescent material layer (7) .

In the above-mentioned structure, the multi-layer fluorescent film is prepared by injecting a composition for the first red fluorescent material layer (6) comprising $Y_2O_2S$:Eu adhered with a pigment by rotary coating method, drying and light-exposing thereof (the layer is not developed); injecting a composition for the second red fluorescencer layer (7) comprising $Y_2O_3$:Eu which is not adhered with a pigment, drying, light-exposing and developing thereof; and coating with acrylic emulsion.

The X-coordinate of a powder color coordinate system of $Y_2O_2S$ :Eu fluorescencer used in the present invention is 0.645±0.005, and the Y-coordinate thereof is 0.635±0.005. The fluorescent material has powder reflexibility [with reference to MgO] of 30–70%. It has advantages of excellent color purity and contrast due to the reduction of reflection of external light by the adhesion of the pigment, while it has a disadvantage of low brightness.

On the other hand, the $Y_2O_3$:Eu fluorescencer has X-coordinate of 0.635±0.005, and Y-coordinate of 0.655±0.005 in the powder color coordinate system, and powder reflexibility of 70% or more. It has a lower color purity than the former, while it has a relatively advantageous brightness.

Therefore, every characteristics cannot be satisfied if the fluorescent material is comprised of mono-layer. However, according to the present invention, both color purity and brightness can be improved by constructing these two fluorescent material as a multi-layer.

The film thickness of the first red fluorescent material layer (6) is preferable 10–50% of the second red fluorescent material layer (7).

If the thickness of the first red fluorescent material layer (6) is less than 10% of the second red fluorescent material layer (7), contrast may be lowered owing to the direct contact of a part of the second red fluorescencer layer onto the face plate. If the thickness is more than 50%, the radiation intensity of the second red fluorescencer layer is relatively weakened, so that the brightness cannot be improved.

Though, in the example of the present invention, the first fluorescent material layer comprises $Y_2O_2S$:Eu, and the second layer comprises $Y_2O_3$:Eu, the composition of each layer can be exchanged, and each layer is not limited to a composition.

According to the present invention, a fluorescent film having high radiation efficiency without lowering overall color purity, by passing the light radiated from the second fluorescencer layer (7) having excellent radiation efficiency through the first fluorescencer layer (6) having excellent color purity.

As described above, according to the present invention, a red fluorescent film is formed to overcome the inherent disadvantages of fluorescent materials, and the characteristics of laminated fluorescent materials having different compositions are complemented each other, to obtain a fluorescent film having improved color purity, brightness, and so on. It provides an excellent fluorescent screen of a fluorescent lamp or a projection type cathode-ray tube as well as a color Braun tube.

The present invention thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A color Braun tube comprising:

fluorescent films with three-color fluorescent materials of green, blue and red, wherein the fluorescent film of the red fluorescent material comprises a plurality of film layers having a laminate structure made of a plurality of different compositions of fluorescent materials.

2. A color Braun tube according to claim 1, wherein the fluorescent film of the red fluorescent material comprises a first film layer of $Y_2O_2S$:Eu and a second film layer of $Y_2O_3$:Eu.

3. A color Braun tube according to claim 2, wherein the film thickness of the said $Y_2O_2S$:Eu layer is 10–50% of that of the said $Y_2O_3$:Eu layer.

4. A color Braun tube according to claim 2, wherein a first red fluorescent material film comprising $Y_2O_2S$:Eu and a second red fluorescent material film comprising $Y_2O_3$:Eu being laminated to each other.

5. A color Braun tube as recited in claim 1, wherein said plurality of film layers comprise a first and a second film layers of red fluorescent materials.

6. The color Braun tube of claim 5, wherein the thickness of said first film layer is 10–50% the thickness of said second film layer.

* * * * *